United States Patent [19]

Biran et al.

[11] 4,390,177

[45] Jun. 28, 1983

[54] FOOT-OPERATED EXERCISING DEVICE

[76] Inventors: Benjamin Biran; Miriam Biran, both of David Pinski St. 25, Haifa, Israel

[21] Appl. No.: 228,760

[22] Filed: Jan. 27, 1981

[30] Foreign Application Priority Data

Feb. 3, 1980 [IL] Israel ..... 59291

[51] Int. Cl.[3] ..... A63B 23/04

[52] U.S. Cl. ..... 272/73; 188/83; 272/132; 272/900; 272/DIG. 4

[58] Field of Search ..... 272/73, 132, DIG. 3, 272/DIG. 4, 900; D21/194; 188/83

[56] References Cited

U.S. PATENT DOCUMENTS

| | | | |
|---|---|---|---|
| 2,668,709 | 2/1954 | Boyko | 272/132 |
| 2,673,088 | 3/1954 | Wentz | 272/132 X |
| 2,909,922 | 10/1959 | Haman | 188/83 U X |
| 3,259,385 | 7/1966 | Boren | 272/73 |
| 3,751,033 | 8/1973 | Rosenthal | 272/73 X |
| 3,910,571 | 10/1975 | Stenn | 272/73 X |
| 4,222,376 | 9/1980 | Praprotnik | 272/73 X |
| 4,262,902 | 4/1981 | Dranselka | 272/73 X |

FOREIGN PATENT DOCUMENTS

| | | | |
|---|---|---|---|
| 2037100 | 2/1972 | Fed. Rep. of Germany | 272/73 |
| 1435830 | 3/1966 | France | 272/73 |
| 1526276 | 4/1968 | France | 272/73 |

*Primary Examiner*—Richard C. Pinkham
*Assistant Examiner*—Arnold W. Kramer
*Attorney, Agent, or Firm*—Benjamin J. Barish

[57] ABSTRACT

A foot-operated exercising device comprises a frame having a longitudinally-extending frame bar terminating at its opposite ends in a pair of transversely-extending frame legs for supporting the frame bar on a horizontal surface, and a pair of foot pedals rotatably mounted on the frame bar about a horizontal, transversely-extending axis. The device further includes a pair of variable-length arms pivotably mounted to one of the frame legs about vertical axes to permit pivotting the arms to an operable position extending at a desired angular relationship axially behind the frame legs, or to a non-operable position in folded relationship with respect to the frame legs.

9 Claims, 4 Drawing Figures

FOOT-OPERATED EXERCISING DEVICE

BACKGROUND OF THE INVENTION

The present invention relates to foot-operated exercising devices, and particularly to the type including a pair of foot pedals rotatably mounted to a frame to be foot-driven by the user for exercise purposes.

Foot-operated exercising devices have become quite popular as a means of providing healthy exercise. The conventional foot-operated devices are usually of the bicycle type, including a seat to be occupied by the user, and a pair of handle bars to be hand-gripped as the user rotates the foot pedals with his or her feet. Such bicycle type exercising devices, however, are bulky in construction and heavy in weight, and are therefore not conveniently portable from one place to another. Moreover, they are costly to construct and therefore carry a high price which limits their use.

Various proposals have been made for building simpler, less expensive foot-operated exercising devices, examples of such latter devices being illustrated in U.S. Pat. Nos. 2,668,709; 2,673,088; 3,259,385; 3,704,886; 3,751,033; 3,968,963; 4,222,376 and 4,225,130, and French Pat. No. 1,526,276. Generally, however, the latter devices can be used only with specially-constructed or specially-dimensioned chairs, or are large and bulky and not collapsible for convenient portability or storage. Primarily for these reasons, such latter devices have not gained the popularity of the conventional bicycle-type foot-operated device.

SUMMARY OF THE INVENTION

An object of the present invention is to provide a novel foot-operated exercising device having advantages in the above respects.

According to a broad aspect of the present invention, there is provided a foot-operated exercising device including a frame having a longitudinally-extending frame bar terminating at its opposite ends in a pair of transversely-extending frame legs for supporting the frame bar on a horizontal surface, and a pair of foot pedals rotatably mounted on the frame bar about a horizontal, transversely-extending axis. The device further includes a pair of arms pivotably mounted to one of the transversely-extending frame legs at spaced points on opposite sides thereof, each of the arms being pivotable about a vertical axis at one side of the frame leg, whereby the arms may be pivoted to an operable position extending at a desired angle to the frame leg to which it is pivotably mounted, axially behind it on the side thereof opposite to the other frame leg or to a non-operable position in folded relationship with respect to the frame legs.

The outer ends of the arms preferably include stabilizing members, such as cup-shaped sockets for receiving the lower ends of a pair of chair legs, and/or inturned end flanges for hooking-on to a mattress frame or the like.

In the preferred embodiment of the invention described below, each of the arms further includes telescoping sections for varying the length thereof, and a locking member for locking the telescoping sections together at the desired length.

According to a further feature included in a preferred embodiment described below, the frame further includes a tubular socket swivelly mounted to the frame bar about its horizontal axis parallel to the frame legs, and a handle bar removably received in the tubular socket.

Foot-operated exercising devices constructed in accordance with the foregoing features provide a number of important advantages over the conventional bicycle-type exercising device, and also over the simpler exercising devices previously proposed in the above-cited U.S.A. and French patents. Thus, the novel construction, particularly the provision of the mentioned pivotably mounted pair of legs, not only permits the device to be compactly folded for transportation or storage, but also permits the device to be used with almost any chair that may be conveniently available to the user, e.g. at the home or office; i.e., it does not require a specially-constructed or a specially-dimensioned chair as do most of the prior known devices. Moreover, the provision of the pivotably-mounted arms, particularly when including the telescoping feature, permits the arms, rather than the frame, to be used for adjusting the distance of the foot pedals from the chair; thus, since no adjustment of the frame itself is required, this enables the use of smaller, more compact and lightweight frames. Further, the swivelly mounted tubular socket and the removable handle bar provide the device with almost all the features of the conventional bicycle-type exerciser but with substantially fewer, simpler, and more lightweight parts.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
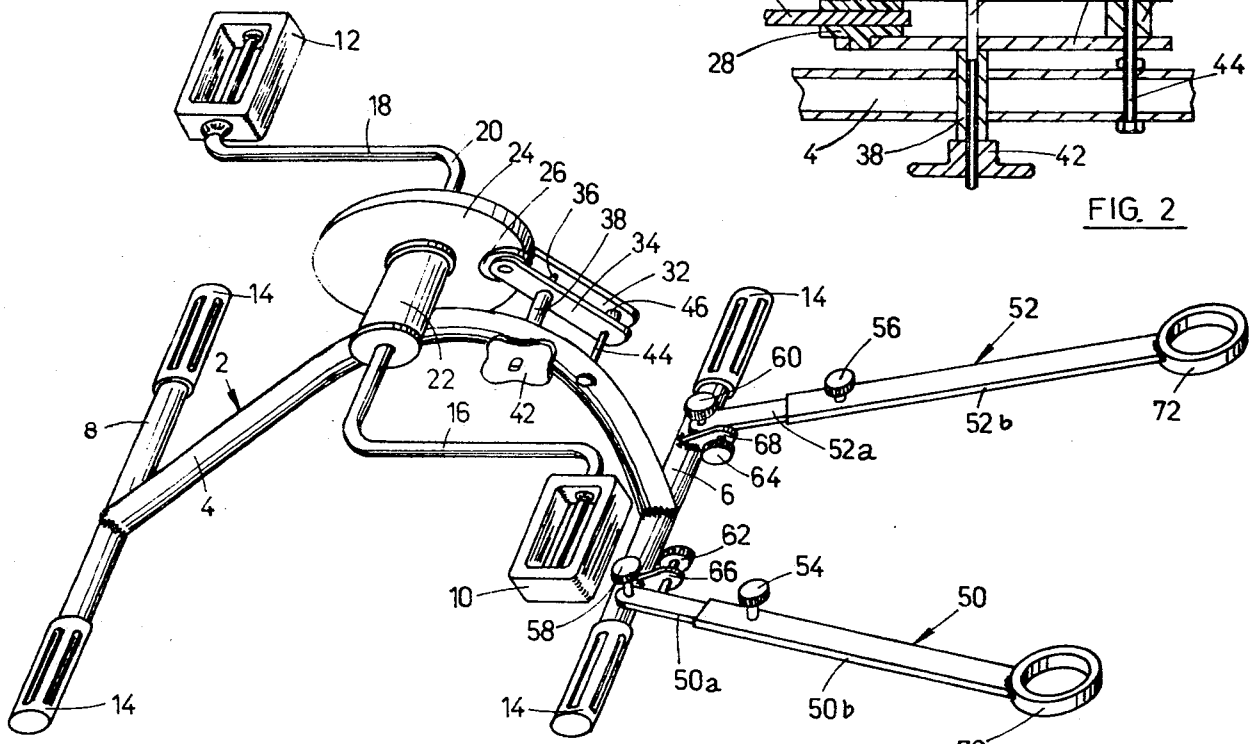
FIG. 1 is a three-dimensional view illustrating one form of foot-operated exercising device constructed in accordance with the invention.

The exercising device illustrated in FIG. 1 includes a frame, generally designated 2, comprising an upwardly-curved frame bar 4 joined at its ends, e.g. by welding, to a pair of frame legs 6, 8. The frame bar 4 extends longitudinally of the device and mounts a pair of rotatable foot pedals 10, 12, while the two legs 6, 8 extend transversely of the device and serve as the means for supporting the device on a horizontal surface, such as the floor. For this purpose, the ends of the frame legs 6, 8 may be provided with rubber or plastic cushioning sleeves 14.

The two foot pedals 10, 12 are rotatably supported on arms 16, 18 joined together by a connecting section 20 rotatably mounted within a bearing 22 secured to the frame bar 4. The two foot pedals arms 16 and 18, and the connecting section 20, may conveniently be formed of a single rod-shaped bar bent as illustrated in FIG. 1. A disc 24 is secured to bar section 20 so as to rotate with the foot pedals 10, 12 and their connecting arms 16, 18.

Figure 2:
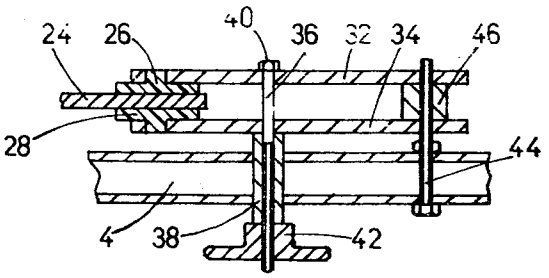
FIG. 2 is an enlarged fragmentary view illustrating certain details of construction of the device of FIG. 1.

The device illustrated in FIG. 1 further includes variable friction means, more particularly illustrated in FIG. 2, engageable with the rotatable disc 24 in order to vary the mechanical loading applied thereto during the rotation of the foot pedals 10, 12. Such variable loading means comprises a pair of friction pads 26, 28, such as of hard plastic material, carried on a pair of arms 32, 34, respectively, straddling the rotatable disc 24. The two arms 32, 34 are received on a pin 36 freely passing through a sleeve 38 fixed to frame bar 4. Pin 36 is formed with a shoulder 40 at one end engageable with arm 32. The opposite end of pin 36 is threaded and receives a rotatable knob 42, the sleeve 38 thus being interposed between knob 42 and arm 34 carrying the inner friction elements 28.

It will be seen that by manually rotating knob 42 so as to thread same inwardly on pin 36, i.e., towards its end shoulder 40, the pin will be drawn inwardly, thereby forcing the two arms 32, 34 towards each other to increase the friction applied by their elements 26, 28 on the rotatable disc 24. Thus, by threading knob 42 inwardly or outwardly on its pin 36, the two friction pads 26, 28 are applied with greater or lesser force against the opposite faces of the rotatable disc 24, thereby enabling the mechanical loading of the rotatable disc to be varied.

The outer end of arms 32, 34, i.e., the ends opposite to their friction pads 26, 28, are fixed to the frame bar 4 by means of a pin 44 secured to the frame bar and passing through openings in the arms, there being a spacer sleeve 46 interposed between the arms.

The device illustrated in FIG. 1 further includes a further pair of arms 50, 52 extending axially from one end of the device, namely from frame leg 6, for engagement with a chair to be occupied by the user, such that the occupied chair stabilizes the frame against movement while the user occupying the chair operates the foot pedals 10, 12. These arms 50, 52 are each constituted of two telescopic sections **50*a*, 50*b* and 52*a*, 52*b*, and are adapted to be fixed in any desired extended position by threaded members or screws 54, 56** threaded through the outer section and engageable with the inner section of the respective arm.

The two arms 50, 52 are removably and pivotably mounted, about a vertical axis, to frame leg 6 by means of further screws 58, 60 passing through the inner section **50*a*, 52*a* of the respective arm into frame leg 6. Thus, the two arms 50, 52 may be pivoted to an operable position extending at a desired angle to frame leg 6 axially behind it on the side thereof opposite to the other frame leg 8. These arms may be fixed in any desired pivoted position by still further screws 62, 64 passing through extensions or lugs 66, 68 of frame leg 6 on the inner side of the arms 50, 52 such that the ends of the fastener screws bear against the inner faces of the inner sections 50*a*, 52*a*** of the arms.

Each of the two arms 50, 52 is provided with a cup-shaped socket member 70, 72. These members are secured, as by welding, to the outer end of the outer section **50*b*, 52*b*** of the respective arm, and are upwardly open so as to receive the lower ends of the legs of any conventional chair (not shown) such that during use, the device is firmly anchored between the occupied chair and the horizontal supporting surface, e.g., the floor.

The manner of using the illustrated device will be apparent from the above description. Thus, when the device is to be used, arms 50, 52 are pivoted to the appropriate angular position behind frame leg 6 so as to space the socket members 70, 72 such as to permit the lower ends of the chair to be received into the socket members. Screws 62, 64 may then be turned until their ends firmly bear against the inner faces of sections **50*a*, 52*a* of the arms to fix their angular position for that particular chair. The arms may then be extended to locate the foot pedals 10, 12 at a comfortable position for the user occupying the chair, and may then be fixed in the extended position by manually turning screws 54, 56**.

The user occupying the chair may rotate the foot pedals 10, 12 with his feet since the device is now firmly stabilized against movement by the weight of the user and of the chair, which weight is applied to the socket members 70, 72, firmly anchoring them to the floor.

The mechanical loading applied to the foot pedals 10, 12 may be varied by manually rotating knob 42. As noted above, when knob 42 is rotated in one direction, it draws arms 32, 34 towards each other, thereby increasing the frictional force applied by the friction pads 26, 28 onto the rotatable disc 24, and when it is rotated in the opposite direction, it reduces the force applied by the friction pads.

When the device is not being used, arms 50 and 52 may be pivoted from their operable position as illustrated in FIG. 1, to a non-operable folded position overlying the frame legs 6 and 8, thereby providing a relatively compact assembly for purposes of transportation or storage.

Figure 4:
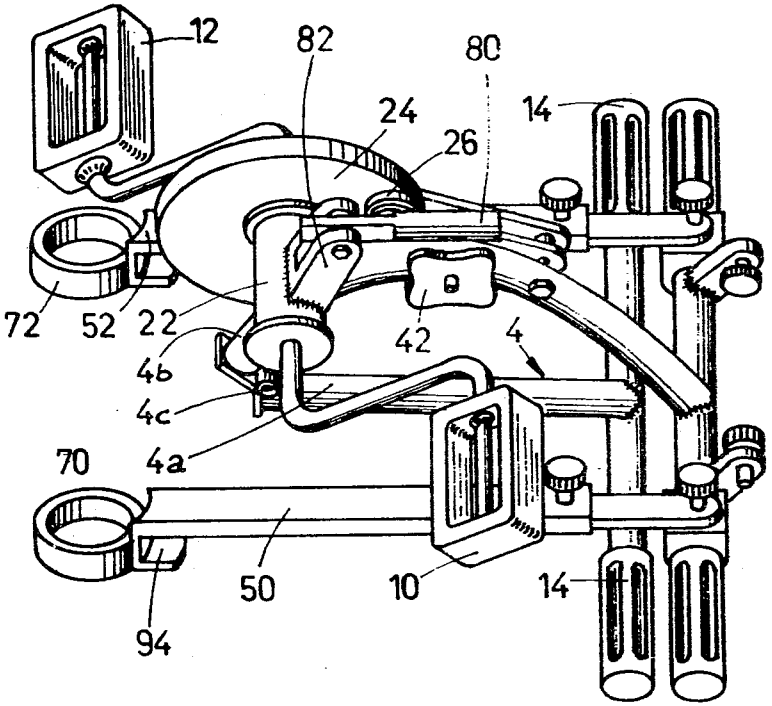
FIGS. 3 and 4 illustrate modifications to the device of FIG. 1 primarily to include a removable handle bar, FIG. 4 illustrating the collapsed condition of the device with the handle bar removed for compact transportation or storage.

FIG. 4 illustrates a modification which may be included to further increase the compactness of the assembly in its non-operable, folded condition. Thus, as shown in FIG. 4, the frame bar 4 is broken into two sections, **4*a*, 4*b*, pivotably connected together by a hinge 4*c*. This arrangement permits one leg of the frame bar to be pivoted towards the other leg, as shown in FIG. 4**, further increasing the compactness of the assembly.

FIG. 4 illustrates several other modifications which may be included.

Figure 3:
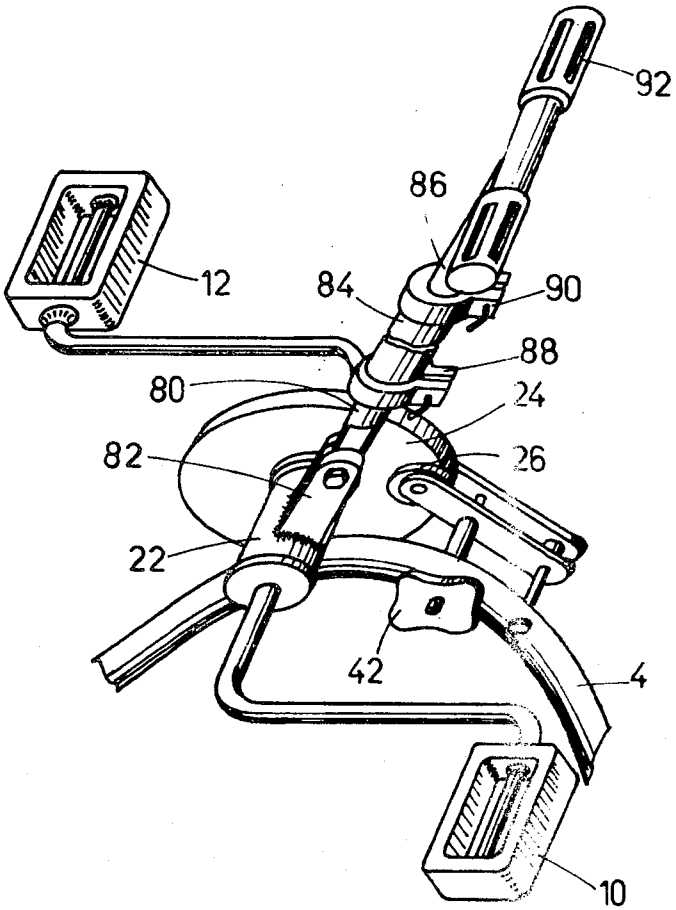

Thus, one modification involves the provision of a tubular socket 80 swivelly mounted by a pair of posts 82 to the bearing 22 secured to frame bar 4. Tubular socket 80 is adapted to receive a handle bar, as illustrated more particularly in FIG. 3, including a pair of telescoping sections 84, 86 adapted to be secured by fasteners 88, 90 to a selected length. A handle bar 92 is fixed to the upper section 86 for hand-gripping by the user. It will be appreciated that the height of the handle bars can be conveniently varied via fasteners 88, 90, and the angular position of the handle bar can also be varied by swivelling its socket 80 within the posts 82. During non-use, the handle bar 92, including its two telescoping sections 84, 86, may be removed from the tubular socket 80. The latter socket may then be pivoted to a horizontal position as shown in FIG. 4, and the two telescoping sections 84, 86 of the handle bar may be telescoped together, thereby providing a very compact arrangement.

Another modification included in the arrangement illustrated in FIG. 4 is the provision of in-turned flanges 94 at the end of each of the arms 50, 52, adjacent to their respective socket members 70 and 72. These in-turned flanges 94 may also serve as stabilizing members engageable with another object, other than a chair, which is relatively fixed with respect to the exercising device for stabilizing it during its use. For example, the in-turned flanges 94 could be engaged by a mattress frame, permitting the device to be operated while the user is lying on his back on a mattress.

While the invention has been described with respect to two preferred embodiments, it will be appreciated that many variations, modifications and other applications of the invention may be made within the scope of the appended claims.

What is claimed is:

1. A foot-operated exercising device including a frame having a longitudinally-extending frame bar terminating at its opposite ends in a pair of transversely-extending frame legs for supporting the frame bar on a horizontal surface during use of the device, and a pair of foot pedals rotatably mounted on the frame bar about a horizontal, transversely-extending axis; characterized in that said device further includes a pair of variable-length arms pivotably mounted to one of said transversely-extending frame legs, each of said arms being pivotable about a respective vertical axis to said one frame leg such that said arms may be pivoted to an operable position behind said one frame leg on the side thereof opposite to the other frame leg or to a non-operable position in folded relationship with respect to said frame legs; each of said arms including means at the ends thereof for anchoring same by an external device.

2. The device according to claim 1, wherein said anchoring means at the outer ends of said arms include cup-shaped sockets for receiving the lower ends of a pair of chair legs for stabilizing the device during its use.

3. The device according to claim 2, wherein said anchoring means at the outer ends of said arms include an in-turned flange formed at the outer end of each arm.

4. The device according to claim 1, wherein each of said variable-length arms includes telescoping sections for varying the length thereof, and a locking member for locking the telescoping sections together at the desired length.

5. The device according to claim 1, further including a pair of threaded pins each threaded through a respective lug fixed to said one leg and adapted to engage the inner faces of the pivotable arms for fixing their angular relationship.

6. The device according to claim 1, further including a disc fixed to said foot pedals to rotate therewith, a pair of friction pads carried on said frame bar and engaging opposite sides of the disc, and a knob mounted on said frame bar and rotatable to vary the force applied by said friction pads against said disc to thereby vary the loading applied to the foot pedals.

7. The device according to claim 6, wherein said pair of friction pads are carried by links straddling the rotatable disc and received on a pin having a shoulder at one end engageable with one link, said rotatable knob being threaded onto the opposite end of the pin, the device further including a sleeve interposed between the knob and the other of said links such that threading the knob further onto the pin forces said links towards each other to increase the friction applied by their friction pads to the rotatable disc.

8. The device according to claim 1, wherein said frame further includes a tubular socket supported by the frame bar, and a handle bar removably received in said tubular socket.

9. The device according to claim 8, wherein said tubular socket is swivelly mounted to said frame bar about a horizontal axis parallel to said frame legs, and said handle bar includes telescoping sections for varying the length thereof.

* * * * *